United States Patent [19]

Ables

[11] Patent Number: 4,694,979

[45] Date of Patent: Sep. 22, 1987

[54] SEAT/BACKPACK/SLED COMBINATION

[76] Inventor: Lee Ables, 37858 N. Greenbay Rd., Waukegan, Ill. 60087

[21] Appl. No.: 869,740

[22] Filed: Jun. 2, 1986

[51] Int. Cl.[4] ..... A45C 15/00

[52] U.S. Cl. ..... 224/151; 224/155; 224/156

[58] Field of Search ..... 224/155, 184, 210, 156, 224/151, 153; 5/114; 280/20

[56] References Cited

U.S. PATENT DOCUMENTS

| | | | |
|---|---|---|---|
| 2,973,888 | 3/1961 | Beardsley | 224/156 X |
| 3,580,592 | 5/1971 | Schrecengost | 280/20 X |
| 3,619,827 | 11/1971 | Mackenzie | 224/156 X |
| 3,799,415 | 3/1974 | Tidd | 224/153 |
| 3,912,290 | 10/1975 | Rich | 280/20 X |
| 4,143,434 | 3/1979 | Monot | 5/114 X |
| 4,234,005 | 11/1980 | Taylor, III | 224/156 X |
| 4,573,695 | 3/1986 | Kennel | 280/20 X |

FOREIGN PATENT DOCUMENTS

| | | | |
|---|---|---|---|
| 76461 | 5/1919 | Austria | 224/156 |

*Primary Examiner*—Stephen Marcus
*Assistant Examiner*—Robert M. Petrik
*Attorney, Agent, or Firm*—John R. Garrett

[57] ABSTRACT

This disclosure depicts a multi-function wilderness seat/backpack/sled combination capable of functioning as a supporting device, a backpack or a light weight sled. The combination comprises a base section having first and second ends and first and second sides. The combination also comprises first and second end sections each having first and second sides, the first end section having a first end hingeably attached to the first end of the base section and the second end section having the first end hingeably attached to the second end of the base section. Each of the end sections has an upwardly extending portion on a second end. In a closed position the upwardly extending portions on the second ends of the first and second end sections meet to form a substantially box-like structure with the base section. In an open position the first and second end sections lie substantially in a common plane with the base section to form a sled-like structure.

15 Claims, 11 Drawing Figures

SEAT/BACKPACK/SLED COMBINATION

BACKGROUND OF THE INVENTION

This invention relates in general to devices structured to carry equipment or objects, and in particular, to backpack and sled-type devices.

Backpacks are well known in the prior art and generally have a rigid frame to which straps are attached. The straps fit over a person's shoulders such that the backpack may be worn on a person's back. Typically, a flexible covering such as canvass, forms an enclosure for holding objects and is attached to the frame.

Sleds are also well known in the prior art and generally have a flat surface to which are attached runners for gliding over snow or similar material. Toboggans typically do not have runner, but rather the flat surface itself contacts the snow. The front of the toboggan curves upward to facilitate gliding over the snow.

The present invention has many applications, but is especially useful for hunting game, such as deer, in wilderness areas covered by snow. A hunter usually must travel long distances on foot when hunting deer. This can be very tiring and hunters often stop to rest. However, sitting down to rest usually means the hunter must sit in the snow. After a deer has been killed, the carcass is usually field dressed, that is parts of the carcass are cut away and left in the wilderness. The remaining carcass, which a hunter must carry or drag for miles, can weight one hundred pounds or more. It is not uncommon for hunters to have heart attacks while trying to bring their game out of the wilderness.

The present invention provides a solution to this problem in the prior art.

SUMMARY OF THE INVENTION

The present invention involes a multi-function wilderness seal/backpack/sled combination capable of functioning as a supporting device, a backpack or a light-weight sled. The combination comprises a base section having first and second ends and first and second sides. The combination also comprises first and second end sections each having first and second sides, the first end section having a first end hingeably attached to the first end of the base section and the second end section having its first end hingeably attached to the second end of the base section. Each of the end sections has an upwardly extending portion on a second end. In a closed position the upwardly extending portions on the second ends of the first and second end sections meet to form a substantially box-like structure with the base section. In an open position the first and second end sections lie substantially in a common plane with the base section to form a sled-like structure.

OBJECTS OF THE INVENTION

It is a general object of the present invention to provide a multi-functional device capable of functioning as a support, a backpack or a sled.

It is a more specific object of the present invention to provide a seat/backpack/sled combination which is light weight and economical to manufacture.

BRIEF DESRIPTION OF THE DRAWINGS

The features of the present invention which are believed to be novel are set forth with particularity in the appended claims. The invention together with further objects and advantages may best be understood by reference to the following description taken in conjunction with the accompanying drainges, in the several figures of which like reference numerals identify like elements, and in which:

DESCRIPTION OF THE PREFERRED EMBODIMENT

Figure 1:
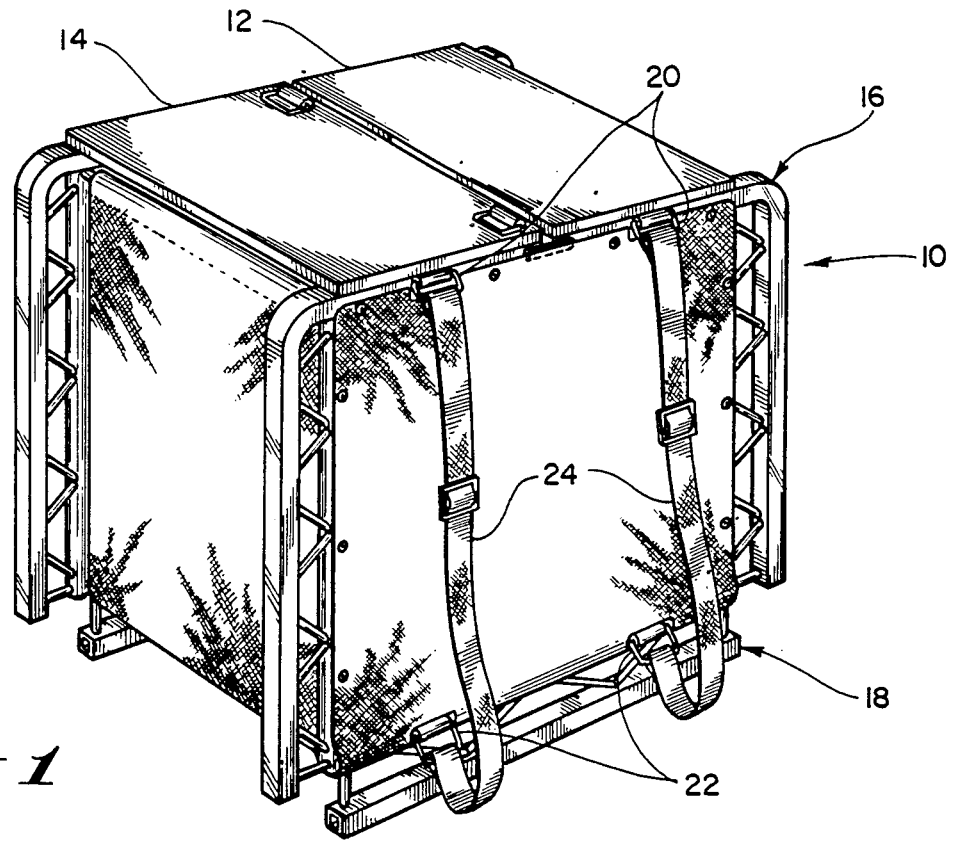
FIG. 1 is a perspective view of the novel seat/backpack/sled combination.

Whereas the present invention may be implemented in various types of structures, it is preferably embodied in a structure of the type shown in FIG. 1. The present invention is a multi-functional seat/backpack/sled combination. It may be placed on the ground and used as a support for a person in the sitting position. It may also be used as a sled for transporting objects, and may further be used as a backpack for carrying objects. The combination functions as a seat and backpack when it is in a closed position and functions as a sled when it is in an open position.

FIG. 1 shows the combination 10 in a closed position. First and second support means 12 and 14 or plates are attached to a top end 16 and provides a seat when a bottom end 18 is placed on the ground. The support means 12 and 14 may be formed from light metal, plastic or other matrials. Attachment means (not shown) can be provided for securing a heat generating cushion over the support means 12 and 14 for supplying heat for a person sitting on the combination during cold weather.

Metal rings 20 or other devices are attached to the top end 16 and metal rings 22 are attached to the bottom end 8 for securing straps 24. The straps 24 can be placed over a person's shoulders allowing the combination 10 to be carried as a backpack. The straps 24 are removably attached to the combination 10 on the preferred embodiment.

Figure 2:
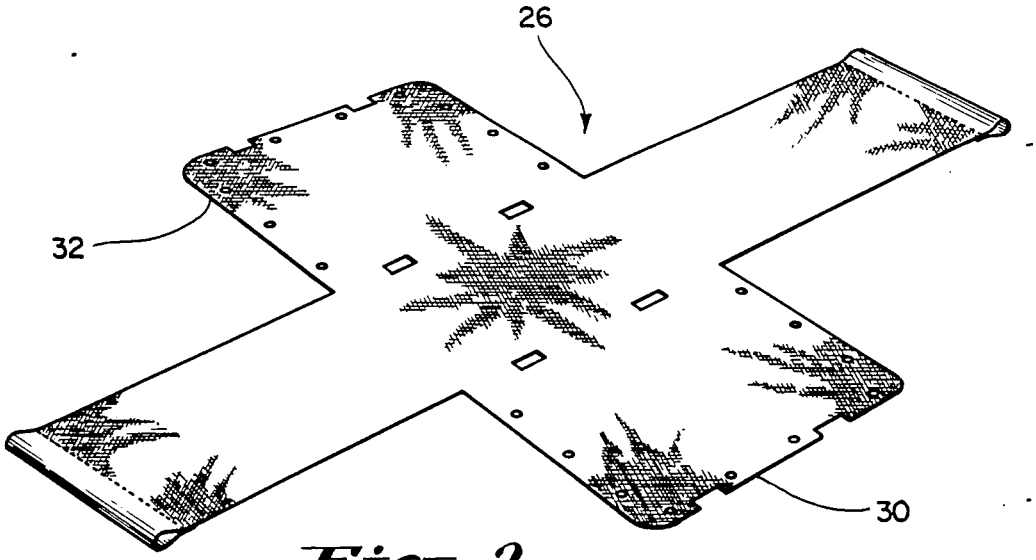
FIG. 2 is a plan view of a flexible covering for use with the combination.

As will be described in detail later, the combination 10 has a light weight metal frame which is enclosed by a flexible covering means 26 as shown in FIG. 2. In the preferred embodiment the flexible covering means 26 has an elongated portion 28 with front and back flaps 30 and 32 attached on either side of and to substantially the center of the elongated portion 28. The flexible covering means 26 may be formed from canvass or other suitable materials. The attachment of the flexible covering means 26 to the frame of the combination 10 will be explained after the structure of the frame is disclosed.

Referring now to FIGS. 3–6, the novel seat/backpack/sled combination has a base section 34 with first and second sides 40 and 42 joining first and second ends 36 and 38. First and second end sections 44 and 48 are provided and have first and second sides 50, 52, 54 and 56 respectively. The first end section 44 has a first end 58 hingeably attached to the first end 36 of the base section 34 and the second end section 48 has a first end 60 hingeably attached to the second end 38 of the base section 34. Each of the end sections 44 and 48 have upwardly extending portions 62 and 64, respectively, on second ends 66 and 68. The sides 50 and 52 join ends 58 and 66 and the sides 54 and 56 join ends 60 and 68.

Figure 3:
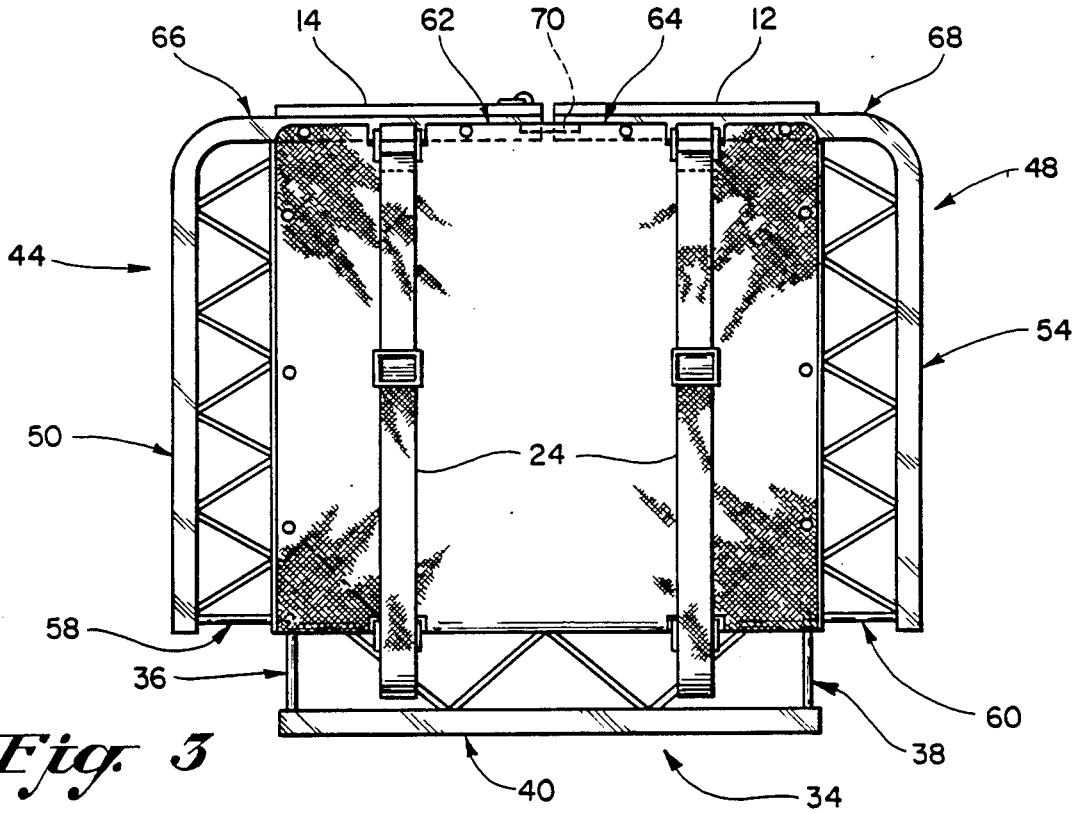
FIG. 3 is a front view of the combination in a closed position.

The combination 10 also has means 70 for securing together the second ends 66 and 68 of the first and second end sections 44 and 48 and is positioned ont he upwardly extending portions 62 and 64 as shown in FIG. 3. The means 70 for securing can be a strap which snaps onto the portions 62 and 64 or any other suitabe device.

Figure 4:
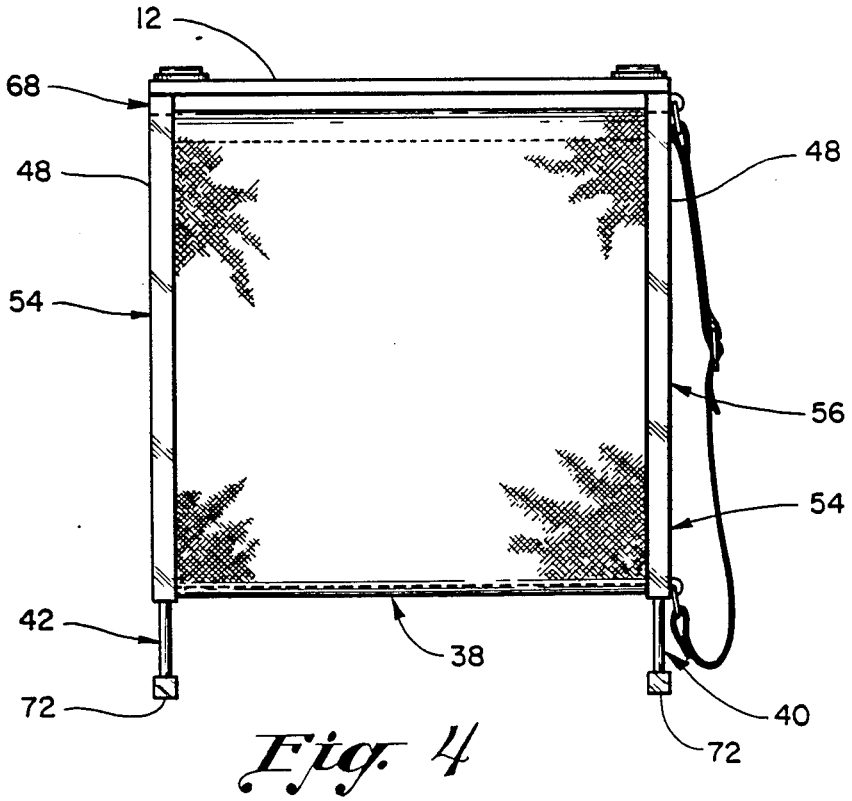
FIG. 4 is a side view of the combination in a closed position.
Figure 5:
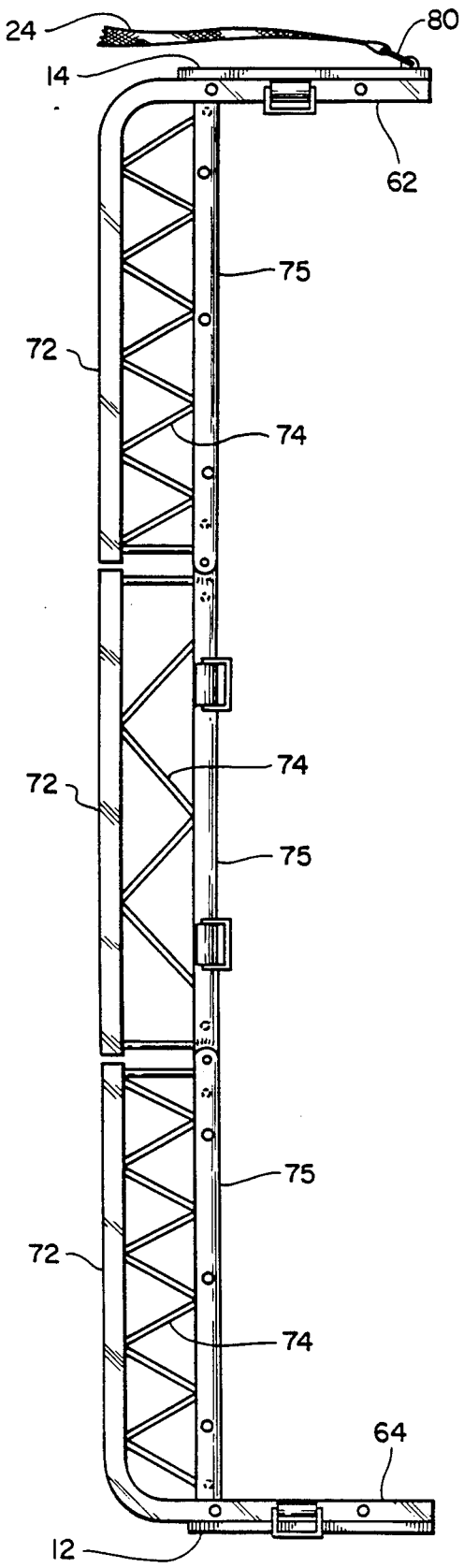
FIG. 5 is a side view of the combination in an open position.
Figure 6:
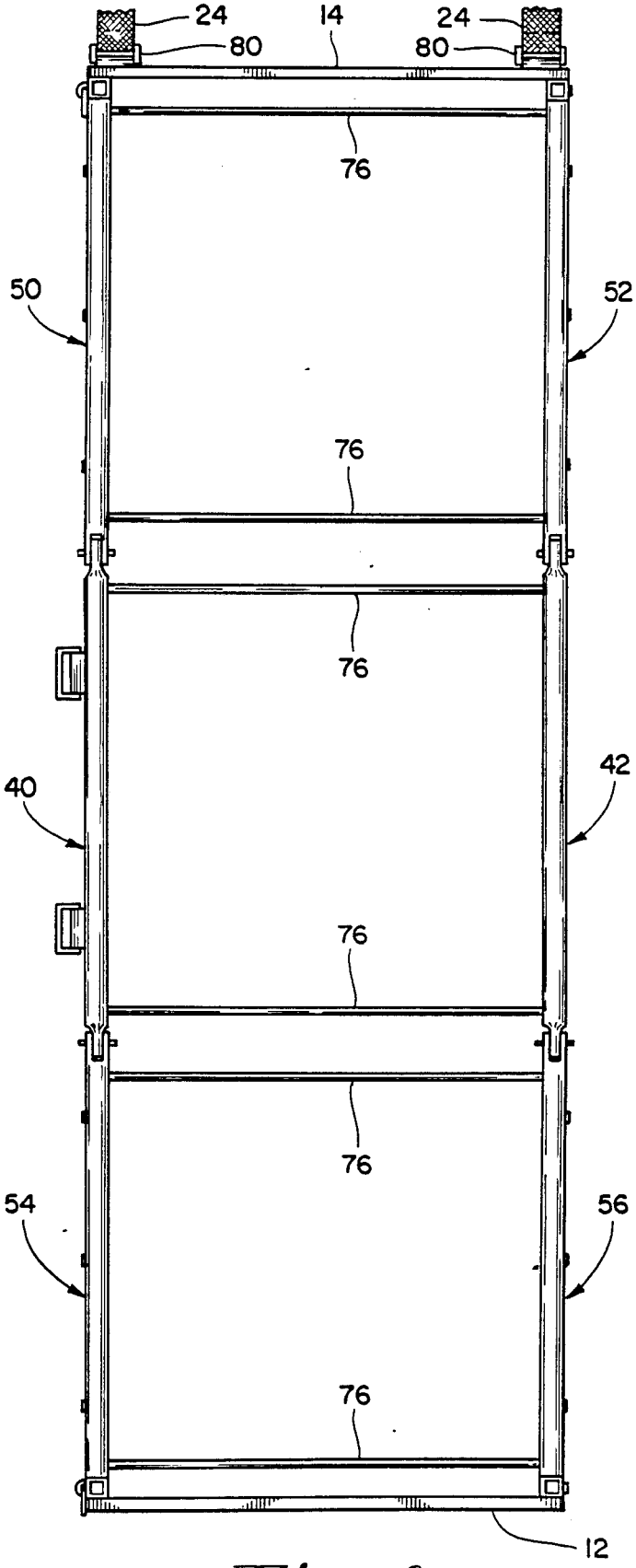
FIG. 6 is a top view of the combination in an open position.

In FIGS. 3 and 4 the combination is in a closed position such that the upwardly extending portions 66 and 68 meet and the first and second end sections 44 and 48 form a box-like structure with the base section 34. In FIGS. 5 and 6 the combination is in an open position such that the first and second sections 44 and 48 lie substantially in a common plane with the base section 34 to form a sled-like structure.

For use in the open position as a sled, means for gliding on snow is provided and in the preferred embodiment are downwardly projecting runners 72 on the first and second sides 50 and 52 of the first end section 44, on the first and second sides 54 and 56 of the second end section 48 and on the first and second sudes 40 and 42 of the base section 34. Supports 74 are provided to atttach the runners 72 to structural members 75 on each of the sides 50, 52, 54, 56, 40 and 42. Cross supports 76 are provided and attached to members 75 to strengthen the combination 10. The runners 72 may have a variety of different shapes and in the preferred embodiment are formed from aluminum tubing having a square cross-sectional configuration. The members 75, supports 74 and cross-supports 76 may be formed of aluminum tubing having a circular cross-sectional configuration. It is to be understood that numerous other shapes and materials could be used, such as injectioned molded plastic parts.

In the preferred embodiment the flexible covering means 26 has elongated portion 28 attached to cross upports 76 and the flaps 30 and 32 have snaps 78 for removable attachment to the first and second sides 50, 52, 54, and 56 of the first and second end sections 44 and 48 to completely enclose the combination 10 when it is in the closed position. In the open position the flaps 30 and 32 may be used to secure an object to be carried on the combination 10 being used as a sled. In the open position the straps 24 are removably attached to rings 80 on either of the upwardly extending portions 62 abd 64 for pulling the combination 10 over snow.

Many variations of covering or enclosing the combination 10 are possible. For example, the base section 34 may be permanently covered with a sheet of aluminum and the first and second end sections 44 and 48 can be covered with individual pieces of canvass or sheet aluminum.Also if the enclosing material is solid, the runners 72 could be omitted and in the open position the combination 10 could glide over snow in a toboggan-like fashion. Alternatively, wheels could be attached for use on dry land.

In the preferred embodiment the base section 34 is substantially square, measuring approximately fourteen inches. Each of the first and second end sections 44 and 48 have a length of approximately seven inches. The runners 72 project downwardly approximately three inches.

Figure 7:
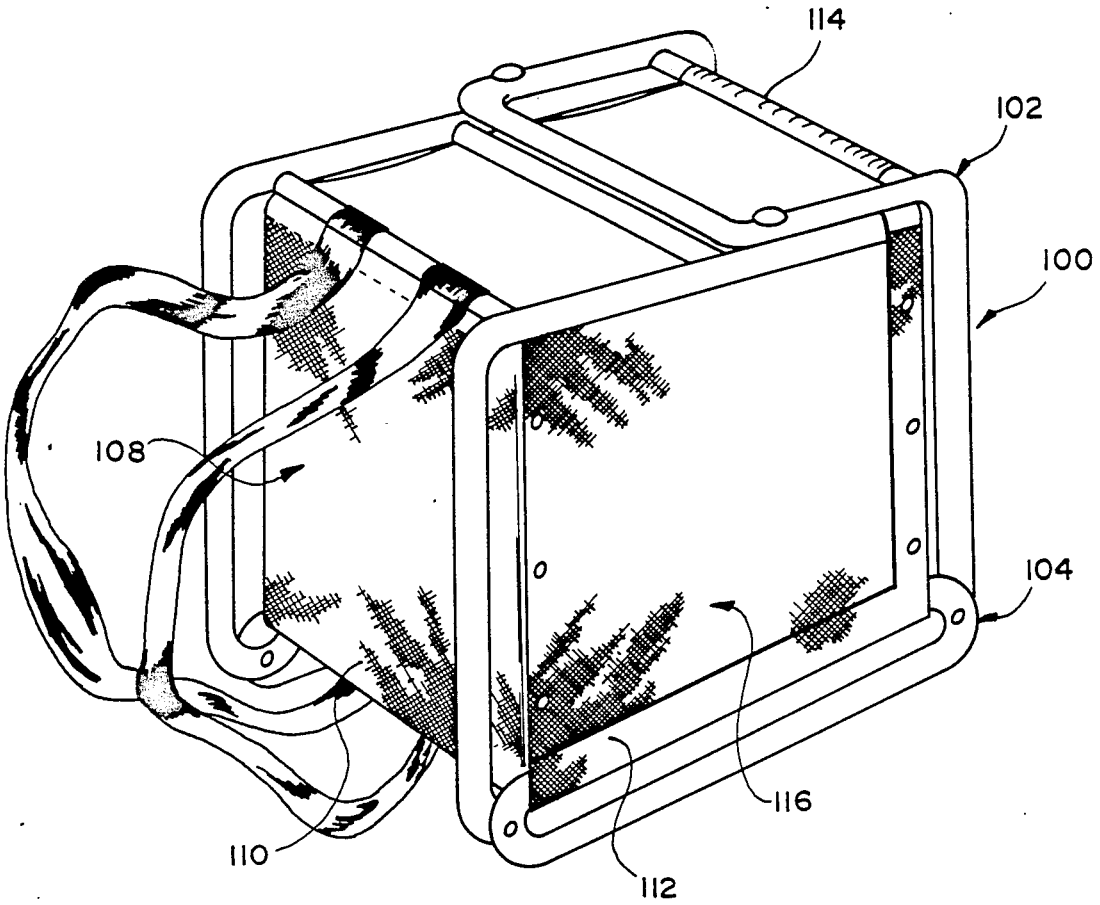
FIG. 7 is a perspective view of an alternative embodiment of the novel seat/backpack/sled combination.

FIG. 7 shows an alternative embodiment in which the combination 100 is in a closed position. This embodiment has been designed as a practical manufacturing version. A top end 102 provides a seat when a bottom end 104 is placed on the ground. Atttachment means (not shown) can be provided for securing a cushion over the top end 102 for a person sitting on the combination.

As will be described in detail later, the combination 100 has a light weight metal frame which has attached a flexible covering 108 as shown in FIG. 7. In the alternative embodiment the flexible covering 108 has three individual sections 110, 112 and 114 with an enclosed portion 116 contained within the combination 100. The flexible covering 108 may be formed from canvass or other suitable materials.

Referring now to FIGS. 8–11, the novel seat/backpack/sled combination has a base section 118 with first and second sides 120 and 122 joining first and second ends 124 and 126. First and second end sections 128 and 130 are provided and have first and second sides 132, 134, 136 and 138, respectively. The first end section 128 has a first end 140 hingeably attached to the first end 124 of the base section 118 and the second end section 130 has a first end 142 hingeably attached to the second end 126 of the base section 118. Each of the end sections 128 and 130 have upwardly extending portions 144 and 146, respectively, on second ends 148 and 150. The sides 132 and 134 join ends 140 and 148 and the sides 136 and 138 join ends 142 and 150.

The combination 100 also has pins 152 for securing together the second ends 148 and 150 of the first and second end sections 128 and 130 and are positioned on the upwardly extending portions 144 and 146.

Figure 8:
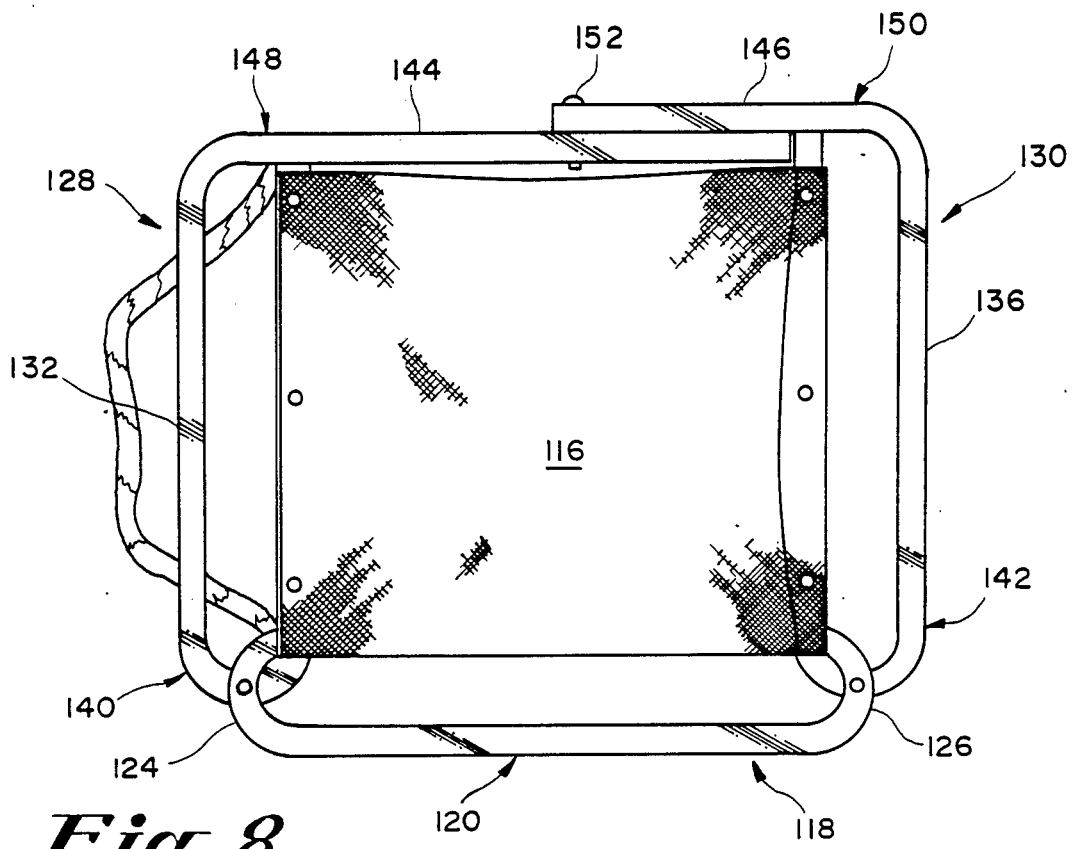
FIG. 8 is a front view of the alternative embodiment in a closed position.
Figure 9:
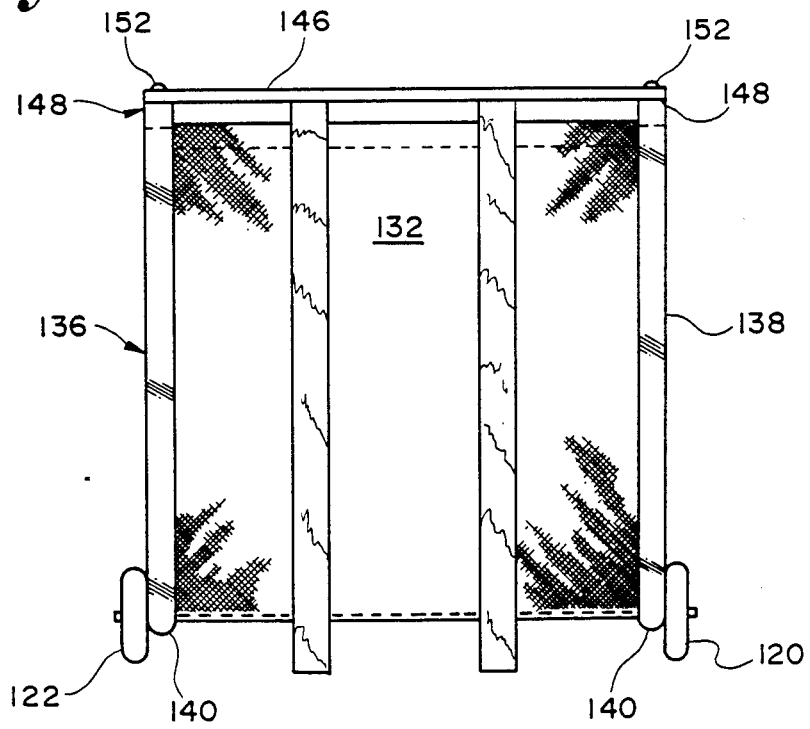
FIG. 9 is a side view of the alternative embodiment in a closed position.
Figure 10:
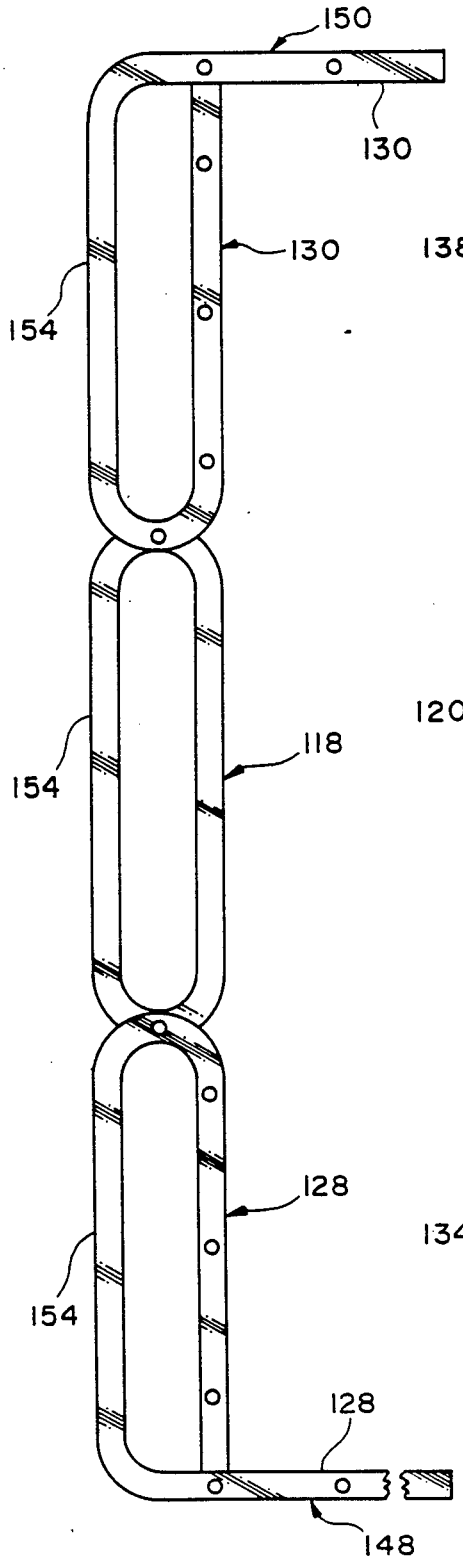
FIG. 10 is a side view of the alternative embodiment in an open position.
Figure 11:
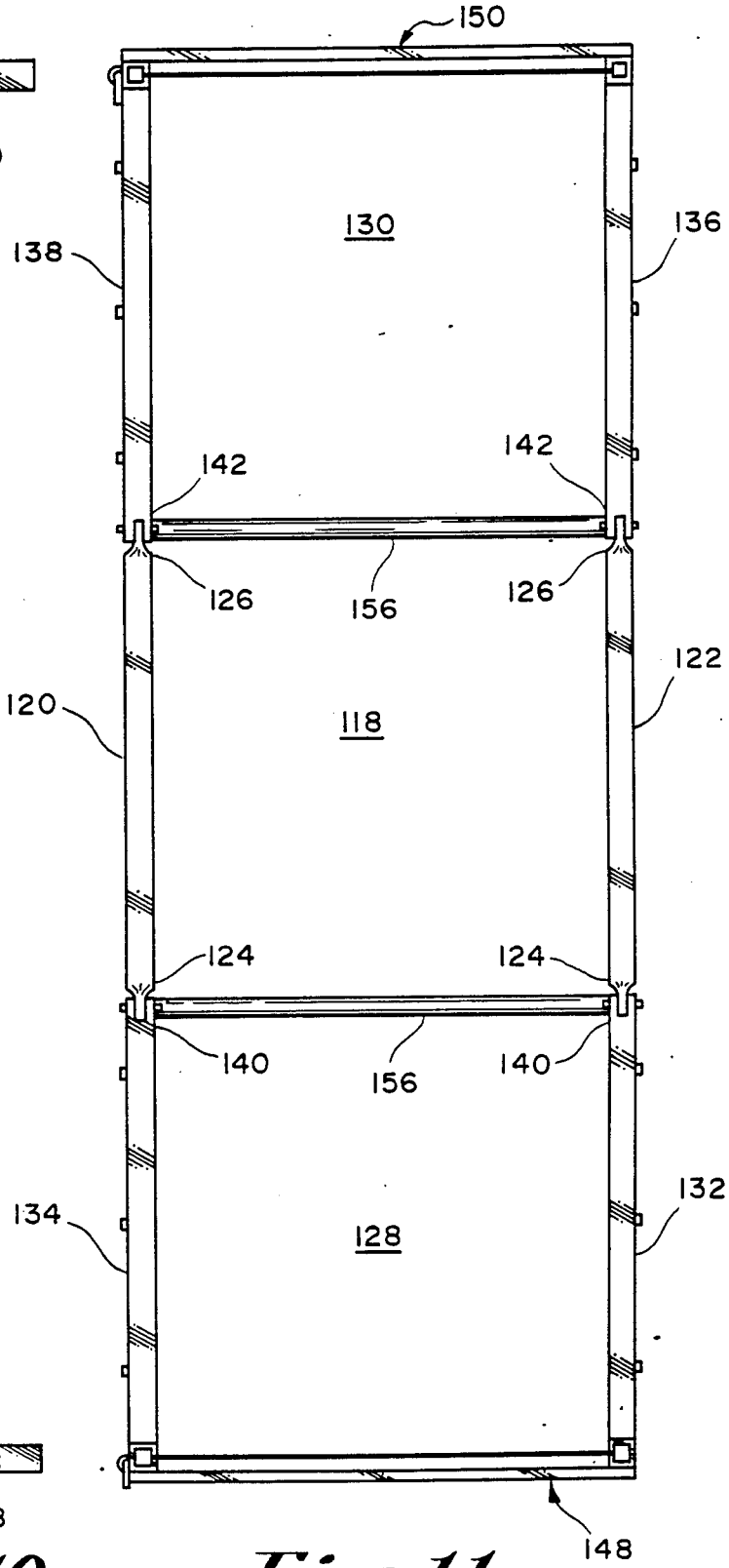
FIG. 11 is a top view of the alternative embodiment in an open position.

In FIGS. 8 and 9 the combination 100 is in a closed position such that the upwardly extending portions 148 and 150 overlap and the first and second end sections 128 and 130 form a box-like structure with the base section 118. In FIGURES 10 and 11 the combination is in an open position such that the first and second sections 128 and 130 lie substantially in a common plane with the base section 118 to form a sled-like structure.

For use in the open position as a sled, means for gliding on snow is provided and in the alternative embodiment are downwardly portion 154 on the first and second sides 132 and 134 of the first end section 128, on the first and second sides 136 and 138 of the second end section 130 and on the first and second sides 120 and 122 of the base section 118. Cross supports 156 are provided to strengthen the combination 100 and also to act as hinges for the base section 118 and the first and second end sections 128 and 130.

The invention is not limited to the particular details of the apparatus depicted and other modifications and applications are contemplated. Certain other changes may be made in the above-described apparatus without departing from the true spirit and scope of the invention herein involved. It is intended, therefore, that the subject matter in the above depiction shall be interpreted as illustrative and not in a limiting sense.

What is claimed is:

1. A multifunction wilderness seat/backpack/sled combination capable of functioning as a supporting device, a backpack or a light-weight sled, said combination comprising:

a base section having first and second ends and first and second sides connecting said first and second ends;

first and second end sections each having first and second sids and, one having a first end hingeably attached to said first end of said base section and the other having a first end hingeably attached to said second end of said base section, and each having an upwardly extending portion on a second end, said first and second sides connecting said first and second ends of each of said first and second end sections;

wherein in a closed position said upwardly extending portions on said second ends of said first and second sections meet to form a substantially box-like structure with said base section to function as a supporting device or a bakcpack and in an open position with said upwardly extending portions of said first and second ends upstanding said first and second sections lie substantially in a common plane with said base section to form a sled-like structure.

2. The apparatus described in claim 1 wherein said first and second sides of said base section and said first and second end sections have means for gliding on snow.

3. The apparatus described in claim 2 wherein said combination further comprises first and second support means for supporting a person in a sitting position attached to said upwardly extending portion of said second ends of said first and second end sections such that in said closed position said combination functions as a seat.

4. The apparatus described in claim 1 wherein said combination further comprises flexible covering means for enclosing said combination having a first elongated portion attached to and covering said first end section, said base section and said second end section, having front and back flaps attached on either side of and to substantially the center of said elongated portion and having a width substantially equal to the length of said base section such that in said closed position said flaps can be removably attached to said first and second sides of said first and second end sections to completely enclose said combination.

5. The apparatus described in claim 1 wherein said combination further comprises means for securing together said second ends of said first and second end sections when said combination is in said closed position.

6. The apparatus described in claim 1 wherein said combination further comprises means for strapping the combination onto a person's back when the combination is in said closed position and removably attached to either said first or second sides of said base section and said first and second end sections.

7. The apparatus described in claim 1 wherein said combination further comprises means for pulling said combination when said combination is in said open position removably attached to either second end of said first or said second end sections.

8. The apparatus described in claim 1 wherein said base section has a length of approximately fourteen inches, said first and second end sections each have a length of approximately eighteen inches with each of the upwardly extending portions having a length of approximately seven inches and wherein said base section and said first and second end sections each have a width of substantially fourteen nches.

9. The apparatus described in claim 1 wherein said base section is substantially square in shape and further comprises a covering attached to said first and second ends and to said first and second sides.

10. The apparatus described in claim 9 wherein said first and second end sections each further comprise a covering attached to said first and second ends and said first and second sides thereof.

11. The apparatus described in claim 10 wherein said combination further comprises front and back covering means attached to said base section along said first and second sides, respectively, and removably attached to said first and second sides of siad first and second end sections when said combination is in a closed position to form an enclosed structure.

12. A multi-function wilderness seat/backpack/sled combination capable of functioning as a supporting device, a backpack or a light weight sled, said combination comprising:

a substantially square base section having first and second ends and first and second sides connecting said first and second ends, said first and second sides having a downwardly extending means for gliding on snow;

substantially rectangular first and second end sections each having first and second sides, said first and second sides each having a downwardly extending means for gliding on snow, and said first end section having a first end hingeably attached to said first end of said base section and said second end section having a first end hingeably attached to said second end of said base section, and each of of said first and second end sections having an upwardly extending portion on a second end, said first and second sides connecting said first and second ends of said first and second end sections, respectively, such that in a closed position said upwardly extending portions ons aid second ends of said first and second end sections meet to form a substantially box-like structure with said base section to function as a supporting device or a backpack and in an open position with said upwardly extending portions of said first and second ends upstanding said first and second end sections lie substantially in a common plane with said base section to form a sled-like structure;

first and second support means for supporting a person in a sitting position and attached to said upwardly extending portions of said second ends of said first and second end sections such that in a closed position said combination functions as a seat;

flexible covering for enclosing said combination having a first elongated portion attached to an covering said first end section, said base section and said second end section, said covering means also having front and back flaps attached on either side of and to substantially the center of said elongated portion and having a width substantially equal to the length of said base section such that in a closed position said flaps can be removably attached to said first and second sides of said first and second end sections to completely enclose said combination to form a backpack;

means for securing together said second ends of said first and second end sections when said combination is in a closed position;

means for strapping said combination onto a person's back when the combination is in a closed position and removably attached to either said first or said second end sections; and means for pulling said combination when said combination is in an open position removably attached to either second end of said first or said second end sections thereby forming a sled.

13. The apparatus described in claim 12 wherein said base section has a length of approximately fourteen inches, said first and second end sections each have a length of approximately eighteen inches with each of the upwardly extending portions having a length of approximately seven inches and wherein said base section and said first and second end sections each have a width of substantially fourteen inches.

14. A multi-function wilderness seat/backpack/sled combination capable of functioning as a supporting device, a backpack or a light weight sled, said combination comprising:

a substantially square base section having first and second ends and first and second sides connecting said first and second ends, said first and second sides having a downwardly extending means for gliding on snow;

substantially rectangular first and second end sections each having first and second sides, said first and second sides each having a downwardly extending means for gliding on snow, and said first end having a first end hingeably attached to said first end of said base section and said second end section having a first end hingeably attached to said second end of said base section, and each of said first and second end sections having an upwardly extending portion on a second end, said first and second sides connecting said first and second ends of said first and second end sections, respectively, such that in a closed position said upwardly extending portions of said second ends of said first and second end sections meet to form a substantially box-like structure with said base section to function as a supporting device or a backpack and in an open positon with said upwardly extending portion of said first and second ends upstanding said first and second end sections lie substantially in a common plane with said base section to form a sled-like structure;

flexible covering attached to at least said base and said first and second end sections;

means for securing together said second ends of said first and second end sections when said combination is in a closed position to function as a bakcpack or a supporting device;

means for strapping said combination onto a person's back when the combination is in a closed position to function as a backpack and removably attached to either said first or said second end of said base section and either of said first or said second end sections; and means for pulling said combination when said combination is in an open position to function as a sled and removably attached to either second end of said first or said second end sections.

15. The apparatus described in claim 14 wherein said second end of said first end section has attached a flexible knapsack which is substantially contained within said combination.

* * * * *